United States Patent [19]

Sims et al.

[11] 4,307,533

[45] Dec. 29, 1981

[54] INSECT SIMULATING MOBILE TOY HAVING FLAPPABLE WINGS

[75] Inventors: Anson Sims, Granada Hills; Lawrence T. Jones, Playa Del Rey; Ashley G. Howden, Los Angeles; Robert S. Lee, West Lake Village, all of Calif.

[73] Assignee: California R & D Center, Culver City, Calif.

[21] Appl. No.: 10,754

[22] Filed: Feb. 9, 1979

[51] Int. Cl.[3] ..... A63H 33/00; A63H 11/00; A63H 11/10

[52] U.S. Cl. ..... 46/22; 46/119; 46/101

[58] Field of Search ..... 46/124, 17, 22, 202, 46/175 R, 1 R, 40, 119, 120, 74 R, 112, 97, 98, 99, 107, 104, 201, 101; 40/417; D21/185, 160

[56] References Cited

U.S. PATENT DOCUMENTS

| | | | |
|---|---|---|---|
| 209,038 | 10/1878 | Gerard | 46/124 |
| D. 216,820 | 3/1970 | Dunbar | D21/185 |
| D. 254,798 | 4/1980 | Johnstone | D21/185 |
| 2,061,189 | 11/1936 | Dungan | 40/417 |
| 2,294,241 | 8/1942 | Rober | 46/124 |
| 2,817,926 | 12/1957 | DeCicca | 46/22 |
| 3,089,279 | 5/1963 | Higgons, Jr. | 46/124 |
| 3,224,136 | 12/1965 | Moryl | 46/22 |
| 3,331,463 | 7/1967 | Kramer | 46/124 |
| 3,577,670 | 5/1971 | Guitierrez | 46/124 |
| 3,724,124 | 4/1973 | Foley et al. | 46/97 |
| 3,866,348 | 2/1975 | Roby et al. | 46/124 |
| 3,928,933 | 12/1975 | Iwamoto | 46/119 |
| 4,043,075 | 8/1977 | Breneman | 46/202 |
| 4,056,896 | 11/1977 | Karasawa | 46/179 |
| 4,114,308 | 9/1978 | Grieder | 46/124 |
| 4,118,888 | 10/1978 | Ogawa | 46/145 |
| 4,214,402 | 7/1980 | Ogawa | 46/17 |

FOREIGN PATENT DOCUMENTS

| | | | |
|---|---|---|---|
| 720085 | of 1932 | France | 46/124 |

*Primary Examiner*—Robert Peshock
*Assistant Examiner*—Michael J. Foycik
*Attorney, Agent, or Firm*—Jackson, Jones & Price

[57] ABSTRACT

A toy configured to simulate an insect with wings is disclosed. The toy has a main body section to which a tail and a head section are attached to form an insect body. Two wings are rotatably mounted for disposition on both lateral sides of the main body section. A mechanism is provided to cause simultaneous flapping of all the wings. A cavity having a pivotable cover plate is provided in the head section. Various toy appendages such as a toy doll may be placed in the cavity.

8 Claims, 9 Drawing Figures

FIG. 3
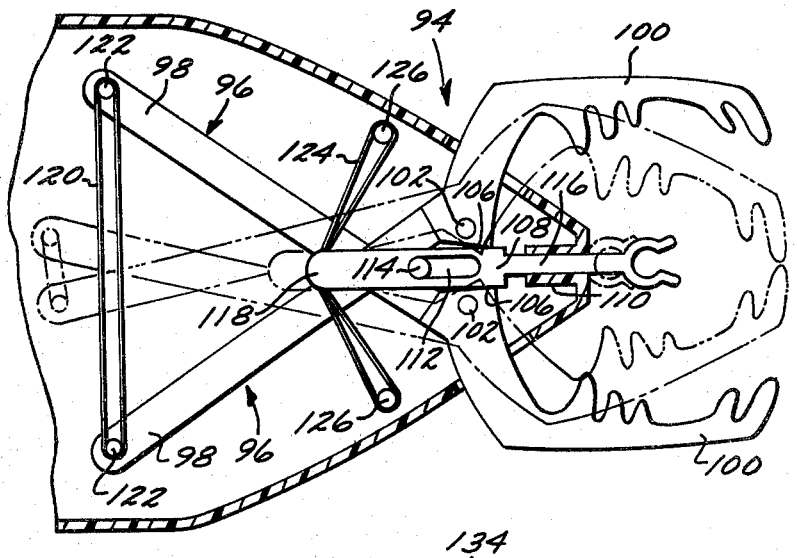
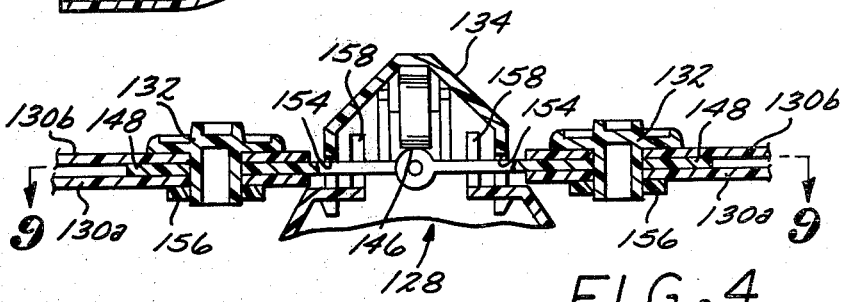
FIG. 4
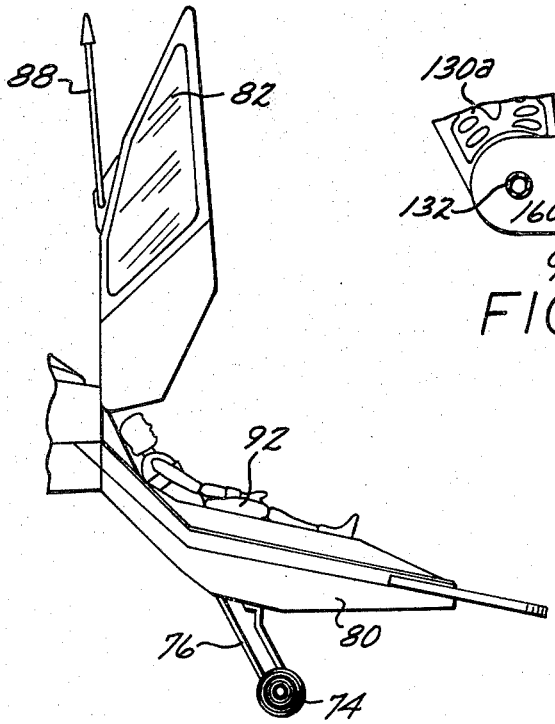
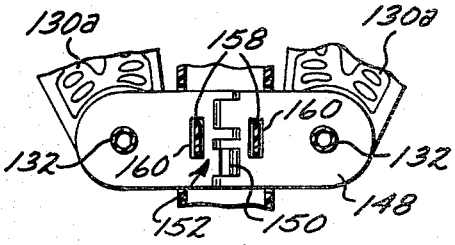
FIG. 9
FIG. 5

FIG. 6
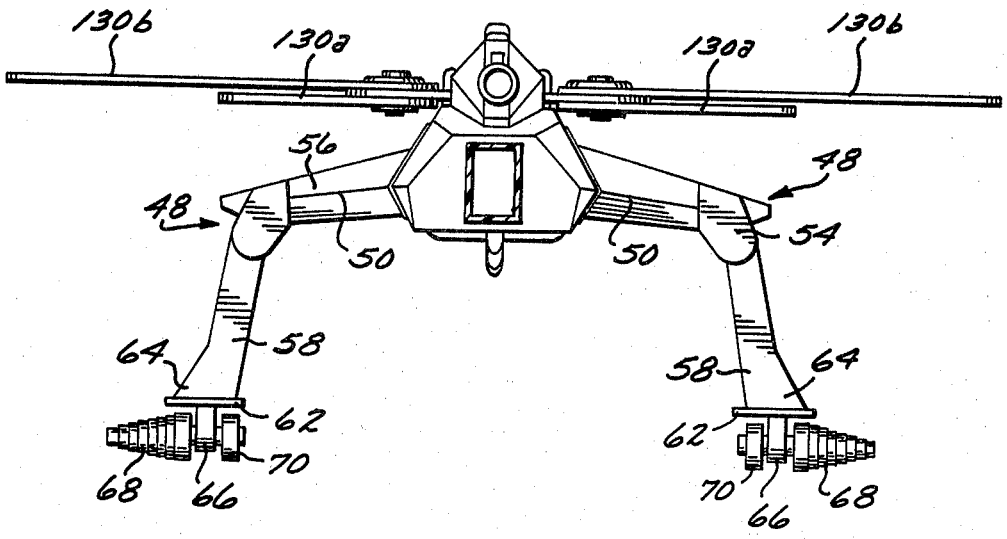
FIG. 7
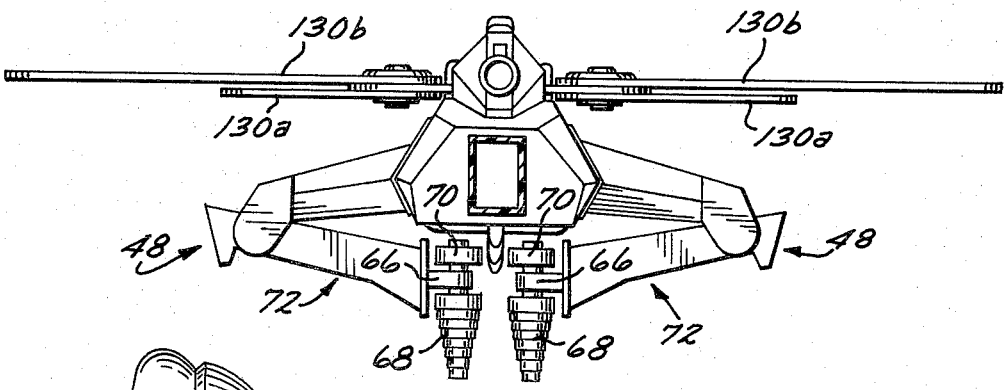
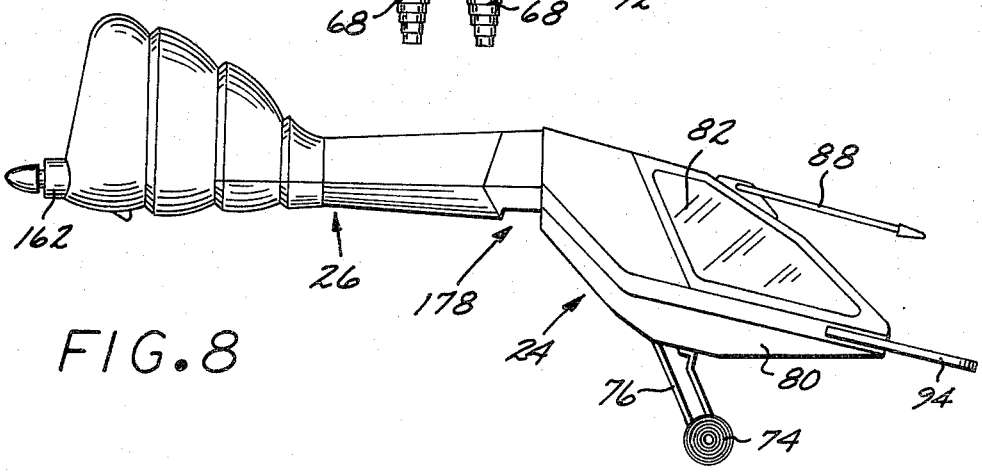
FIG. 8

INSECT SIMULATING MOBILE TOY HAVING FLAPPABLE WINGS

BACKGROUND OF THE INVENTION

1. Field of the Invention

The present invention relates to a mobile toy, and more particularly to a mobile toy which is configured to simulate an insect, has player actuated flapping wings and incorporates a cavity to accomodate various toy appendages.

2. Brief Description of the Prior Art

The prior art is well aware of toys configured to simulate various animals.

The prior art is also well aware of mobile toys such as toy vehicles which accomodate various toy appendages including toy dolls.

Nonwithstanding the present availability of a large variety of toys, the toy industry is constantly striving to create new toys which provide novel play options, and appeal to the creative imagination of the children playing with the toys. Accordingly, there is a need in the toy manufacturing arts for a mobile insect simulating toy having the features of the toy of the present invention.

SUMMARY OF THE INVENTION

It is an object of the present invention to provide a toy which is configured to simulate an insect.

It is another object of the present invention to provide a toy which has a plurality of flappable wings which may be individually pivoted about a vertical axis.

It is still another object of the present invention to provide a toy simulating an insect which incorporates a cavity wherein a toy doll may be seated.

It is yet another object of the present invention to provide a toy which has a pair of player actuated mandibles capable of gripping and releasing an object at the option of a player.

It is still a further object of the present invention to provide a toy which has a general science-fiction type appearance.

These and other objects and advantages are attained by a toy having an elongated body member which includes a head section, a center or main body section and a tail section. A plurality of wings are mounted to the center section in such a manner that at least one wing is disposed on each lateral side of the body member. The wings are individually pivotable about a substantially vertically disposed axis. A mechanism is provided to cause up-and-down flapping motion of the wings.

A cavity is incorporated in the head section to accomodate toy appendages such as a toy doll. A pivotable cover or canopy is attached to the head section to cover the cavity or to provide access thereto at the option of a player.

The objects and features of the present invention are set forth with particularity in the appended claims. The present invention may be best understood by reference to the following description, taken in connection with the accompanying drawings in which like numerals indicate like parts.

BRIEF DESCRIPTION OF THE DRAWINGS

FIG. 3 is a top view of a mandible or pincer actuating assembly of the preferred embodiment of the present invention, the view being taken at lines 3—3 of FIG. 2;

FIG. 4 is a cross sectional view of a wing flapping motion actuating assembly of the preferred embodiment of the toy of the present invention, the cross section being taken at lines 4—4 of FIG. 2;

FIG. 5 is a partial side view of the preferred embodiment of the toy of the present invention, the view showing a pivotable canopy cover for a cavity in a head section being in an open position;

FIG. 6 is a cross sectional view of the preferred embodiment of the toy of the present invention, the cross section being taken at lines 6—6 of FIG. 2;

FIG. 7 is a cross sectional view of the preferred embodiment of the toy of the present invention showing a plurality of legs of the toy in a folded position, the view being analogous to the cross sectional view taken at lines 6—6 of FIG. 2;

FIG. 8 is a side view of a second toy configured from a tail and a head section of the toy of the present invention, and FIG. 9 is a view of the wing flapping motion actuating assembly of the preferred embodiment of the toy of the present invention, the view being taken at lines 9—9 of FIG. 4.

PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that various modifications can be accomplished within the parameters of the present invention.

Figure 1:
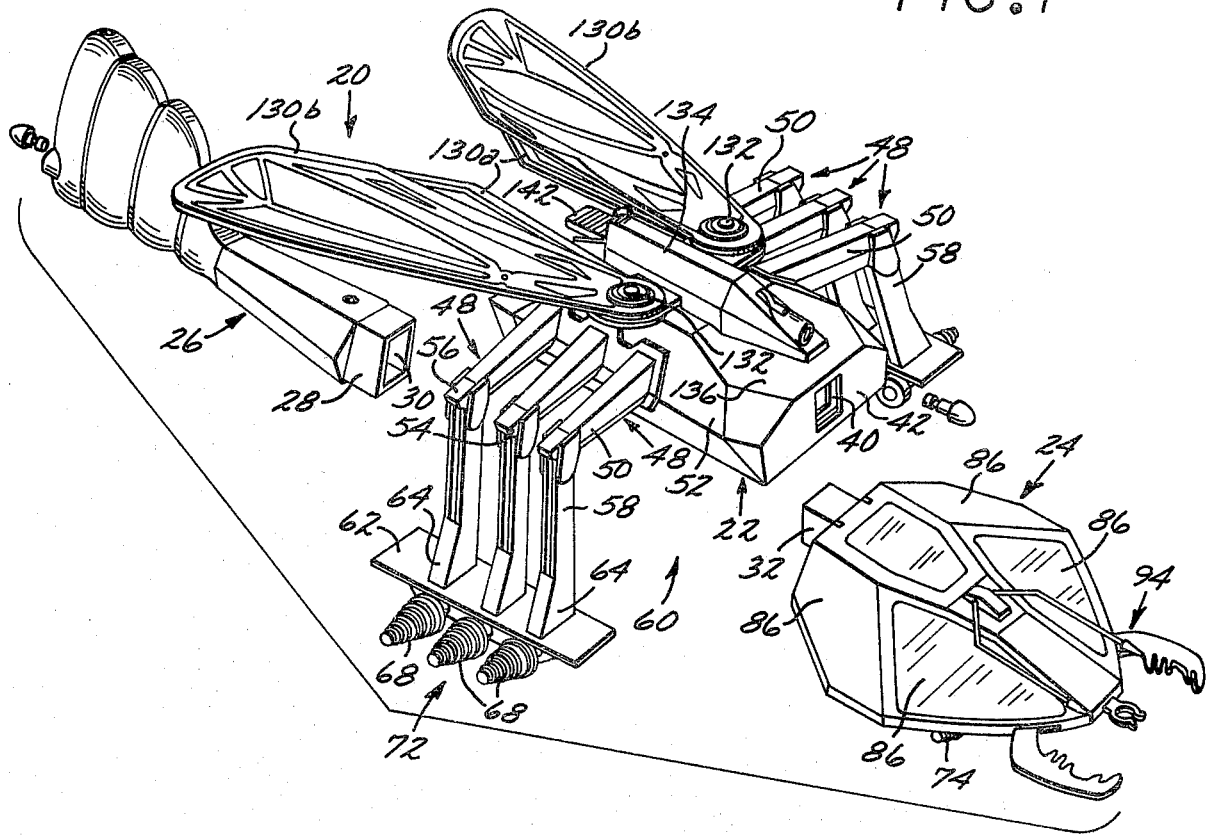
FIG. 1 is a partially exploded perspective view of a preferred embodiment of the toy of the present invention.
Figure 2:
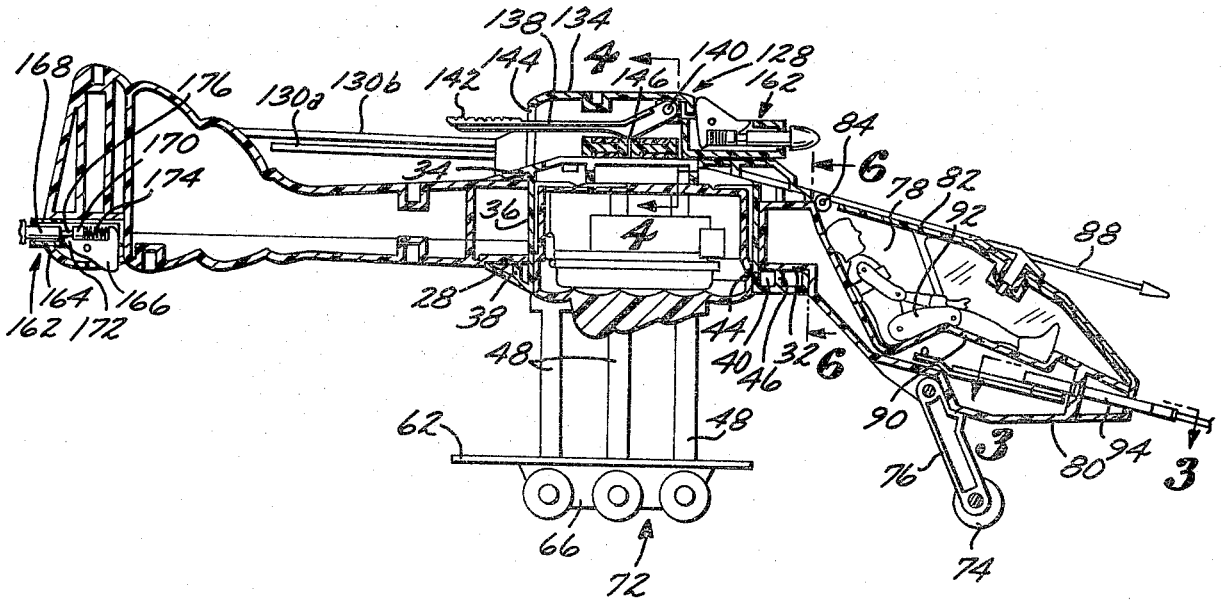
FIG. 2 is a cross sectional view of the preferred embodiment of the toy of the present invention, the cross section being taken at lines 2—2 of FIG. 1.

Referring now to the drawings and particularly to FIGS. 1 and 2, a preferred embodiment of the toy 20 of the present invention is disclosed in detail. The toy 20 is generally configured in the shape of an insect, and is perhaps best generally described as a science fiction type image of an insect.

The toy 20 includes a center or main body section 22, a frontal or head section 24 and a tail section 26. As is shown in FIG. 1, the sections 22, 24 and 26 are configured to simulate corresponding parts of an insect. Thus, the head section 24 has the general configuration of an insect head, the center section 22 has the general configuration of the thorax of an insect, and the tail section 26 has the general configuration of the abdomen and tail of an insect.

The tail section 26 which comprises a stylized elongated body, terminates in its foremost portion in a male plug 28. The plug 28 has a square shaped cross section and is hollow so that it incorporates an aperture 30 which is also square shaped. In an alternative configuration of the preferred embodiment of the toy 20 of the present invention shown on FIG. 8, the square aperture 30 itself acts as a female receiver for a plug 32 located on the head section 24. A direct connection of the head section 24 to the tail section 26 in this alternative configuration is further described below.

Referring back to FIGS. 1 and 2, assembly of the center or main body section 22 to the tail section 26 is disclosed. A rear portion of the main body section 22 incorporates an aperture 34, shown on FIG. 2. The aperture 34 is configured to receive and hold the plug 28 by friction. A vertically disposed spacer wall 36 comprises a bottom of the aperture 34 and a relatively short vertically disposed rib 38 provides support for the plug 28. The rib 38 which interfaces with the plug 28 prevents a wobbling motion of the tail section 26 relative to the main body section 22.

A second aperture 40 having a square cross section is incorporated in a frontal portion 42 of the main body section 22. The second aperture 40 which also has a vertically disposed spacer wall 44 and a short rib 46, is configured to receive and hold the plug 32 by friction thereby attaching the head section 24. Thus, the three sections 22, 24 and 26 of the toy 20 are readily assembled to one another through friction fitting the plugs 28 and 32 into the respective apertures 30 and 40 in a manner easily performed by a child.

Referring now to FIGS. 1, 2, 6 and 7 a plurality of foldable legs 48 of the toy 20 are disclosed. Three spaced, parallelly aligned first elongated members 50 extend laterally from each side 52 of the main body section 22. The general longitudinal axes of the elongated members 50 describe a small acute angle with a horizontally disposed plane (not shown) so that the first elongated members 50 simulate upper leg sections of a six footed insect.

An articulated joint 54 is provided at an end 56 of each elongated member 50. Each joint 54 pivotably receives a second elongated member 58. These in their usual position, shown in FIG. 1, are disposed substantially vertically so as to simulate lower leg sections of a six footed insect. The construction of the joints 54 may be performed according to standard practice in the toy manufacturing arts and therefore need not be described here in detail. It is preferred however to configure the interfacing portions of the first 50 and second elongated members 58 in such a manner that a pivoting motion of the second elongated members 58 is limited towards the main body section 22, as indicated by an arrow 60 on FIG. 1.

A substantially horizontally disposed cross plate 62 rigidly interconnects the second elongated member 58 in their lower ends 64. The cross plate 62 may be integrally molded with the second elongated members 58. Generally speaking, the several component parts of the toy 20 of the present invention may be conveniently manufactured by injection molding of suitable plastic material such as polystyrene.

A wheel support plate 66, shown in FIGS. 2, 6 and 7 is disposed transversely to each cross plate 62. A large wheel 68 and a small wheel 70, best shown in FIGS. 6 and 7, are pivotably mounted in the wheel support plate 66 below each second elongated member 58. Thus, three large 68 and three small wheels 70 are mounted on each side 52 of the main body section 22. The wheels 68 and 70, the cross plate 62, the wheel support plate 66, and the first 50 and second 58 elongated members comprise a leg assembly 72 on each side of the main body section 22.

The small wheels 70 are located on the inside of each leg assembly 72, as is shown on FIGS. 6 and 7. Therefore when the second elongated members 58 are pivoted in the joints 54 the small wheels 70 are readily accomodated in a space below and in close proximity to the main body section 22. Because the second elongated members 58 are rigidly interconnected with the cross plate 62, the leg assembly 72 on each side 52 of the main body section 22 folds up as a unitary piece. Each leg assembly 72 effectively simulates the legs of a six footed insect, while the wheels 68 and 70 provide for locomotion of the toy 20 along a support surface (not shown). Two additional wheels 74 configured similarly to the large wheels 68 are pivotably mounted to a bar 76 suspended from the head section 24. These additional wheels 74, only one of which is shown in FIGS. 1, 2, 5 and 8 provide further support to the toy 20 on a support surface.

Referring now again to FIGS. 1, 2 and particularly to FIG. 5 a cavity 78 incorporated in the head section 24, is shown. The hollow head section 24 comprises a lower base member 80 and a cover plate 82 mounted to the base member 80. The cover plate 82 is pivotable relative to the base member 80 about a hinge 84 which is disposed in the head section 24 adjacent to the plug 32. The cover plate 82 comprises a plurality of panel members 86 angularly disposed relative to one another. The assembled cover plate 82 and lower base member 80 are configured to effectively simulate the head of an insect. The realistic, insect head like appearance of the head section 24 is further enhanced by a pair of forwardly projecting spaced, relatively narrow, pointed cylindrical members 88 which simulate the antennae of an insect. The cylindrical members 88 are fixedly attached to the cover plate 82.

The cavity 78 incorporated in the head section 24 has as its lower boundary a support plate 90, shown in the cross sectional view of FIG. 2. The support plate 90 has the contour of a seat of an airplane cockpit or the like. A doll figure 92 simulating an airplane pilot or a space traveller may be seated upon the support plate 90, as is shown in FIGS. 2 and 5. Access to the cavity 78 to seat or unseat the doll figure 92 can be had by positioning the cover plate 82 in an upwardly, open position, as is shown on FIG. 5.

The head section 24 further includes an assembly of mandibles generally designated as 94. For a detailed description of the assembly of mandibles 94 reference is made to FIG. 3. The assembly of mandibles 94 comprises two extended plates 96 whose overall length greatly exceeds its overall width. Each extended plate 96 has a straight portion 98 which is entirely contained in the head section 24. A stylized portion 100 abuts the straight portion 98 of each extended plate 96. The stylized portions 100 are configured to simulate a mandible or pincer of an insect and extend out of the head section 24 in a forwardly direction. The two extended plates 96 are disposed overlapping one another in a configuration which is similar to the configuration of a scissor.

Each extended plate 96 is pivotable about an axle 102 which is located inside the head section 24 approximately at the junction of the straight 98 and stylized portions 100. The axles 102 comprise cylindrical protrusions which extend from the lower base member 80 of the head section 24 and engage matchingly configured apertures in the respective plates 96. A section of each extended plate 96 wherein the stylized portion 100 is contiguous to the straight portion 98 is configured to form a ridge 106. A straight elongated member 108 is disposed between the ridges 106 and is also slidingly held in a tubular configuration 110 provided in the lower base member 80. An elongated slot 112 disposed in the direction of the longitudinal axis of the straight elongated member 108 is provided therein. A cylindrical protrusion or peg 114 extending from the lower base member 80 engages the slot 112 so that the straight elongated member 108 has a limited freedom of an in-and-out sliding movement relative to the lower base member 80. The straight elongated member 108 is generally configured to simulate a feeler antenna of an insect.

A portion 116 of the straight elongated member 108 which is disposed to slide in the tubular configuration 110 is narrower than a second portion 118 which has the slot 112. The dimensions of the respective first, narrow 116 and second, wider 118 portions are selected in such a manner, that when the second wider portion 118 is disposed between the ridges 106 the extended plates 96 are forced into a maximally open configuration, as is shown by solid lines on FIG. 3. Conversely, when the narrow portion 116 is disposed between the ridges 106, the extended plates 96 may be disposed in a closed configuration wherein two ends of the stylized portions 100 abut one another. This corresponds to a closed configuration of the mandibles of an insect, and is shown by phantom lines on FIG. 3.

A first elastic rubber band 120 is attached to the straight portions 98. It provides a force attempting to place the extended plates 96 into a closed configuration. The rubber band 120 is anchored on a peg or protrusion 122 provided on each straight portion 98.

A second elastic rubber band 124 is anchored on two pegs 126 provided in the lower base member 80. The second rubber band 124 engages the straight elongated member 108 and provides a force attempting to move it outward into a position wherein its wider portion 118 forces the mandibles into an extended configuration.

As it should be readily apparent from the above description, when an object (not shown) is placed between the extended plates 96 it pushes the straight elongated member 108 inwardly against the force of the second rubber band 124. Therefore the narrower portion 116 is moved to occupy space between the ridges 106 and the extended plates 96, comprising the mandibles, attempt to close under the force of the first rubber band 120. The object (not shown) is gripped in this manner by the mandibles. When the object (not shown) is removed, the above described process is reversed. The straight elongated member 108 moves outward and its second wide portion 118 forces the extended plates 96 apart again. Thus the above described assembly of mandibles 94 effectively simulates the mandibles or pincers of a live insect.

Referring now to FIGS. 1, 2, 4 and 9 a wing flapping assembly 128 of the preferred embodiment of the toy 20 of the present invention is disclosed in detail. Four wings 130 are mounted to the main body section 22 in such a manner that a pair of wings 130 is disposed on each lateral side 52. The wings 130 comprise stylized plates which are configured to simulate the wings of an insect capable of flight. Each pair of wings 130 comprises a lower wing 130A and an upper wing 130B, and each pair is rotatably mounted upon a mounting pin or axle 132.

An elongated hollow housing 134 is disposed on a top surface 136 of the main body section 22 in substantial alignment with the general longitudinal axis of the same. A lever 138 pivotably attached at one end thereof to a lever mounting pin 140, is located in the housing 134. A free end 142 of the lever 138 protrudes from the housing 134 through an opening 144 provided in the housing 134. The lever 138 includes a camming surface 146 which is configured to move a pair of wing mounting plates 148 up and down as the lever 138 is manipulated by a player.

In order to fully describe the wing flapping assembly 128 particular reference is made to FIGS. 4 and 9 wherein the wing mounting plates 148 are best shown. The two wing mounting plates 148 each comprise substantially flat plates which are hinged to one another by a pair of hinge pins 150. One of the hinge pins 150 is shown on FIG. 9. A hinge assembly 152, held together by the hinge pins 150, is disposed immediately below the camming surface 146, as is best shown in FIG. 4.

The wing mounting plates 148 protrude from the housing 134 in a lateral direction through openings 154 which are sufficiently large to allow for an up and down flapping motion of the wing mounting plates 148. One wing mounting pin 132 is located on each mounting plate 148. Each wing mounting pin 132 bears a lower 130A and an upper wing 130B. These are mounted respectively below and above the wing mounting plates 148 through a circular aperture located in the respective wing 130. Therefore each wing 130 is individually rotatable about the wing mounting pin or axle 132. A washer or lock nut 156 is snap fitted on each wing mounting pin 132 to secure the assembly of the wings 130 to the wing mounting plates 148.

Two small bars or plates 158 extend upwardly from the top surface 136 of the main body section 22 to loosely engage a slot 160 in each wing mounting plate 148. The purpose of these bars 158 is to secure the wing mounting plates 148 against a lateral sliding movement while allowing for an up and down flapping movement.

The operation of the wing flapping assembly 128 is readily apparent from the above description. As a player pushes down on the free end 142 of the lever 138, the camming surface 146 causes the hinged parts of the wing mounting plates 148 to move downward. As a result, the rest of the wing mounting plates 148 including the portions bearing the wing mounting axles 132 move upward carrying the wings 130 with them. As the player releases the lever 138, the weight of the wings 130 forces them to return into their usual position. From there, they can be lifted up again by another downward push on the lever 138. The individual wings 130 are capable of flapping regardless of their angular disposition relative to the main body section 22.

Referring now back to FIGS. 1 and 2 a pair of toy missile launchers 162 is disclosed in detail. One of these is attached respectively to the tail section 26 and to the main body section 22. Each missile launcher 162 has a tubular housing 164 including a slot through which a pivotably mounted trigger piece 166 enters the tubular housing 164. An elongated body of a toy missile 168 includes a cylindrical section 170 which forms a ridge 172. The missile 168, when inserted into the tubular housing 164, compresses a coil spring 174. A narrow portion 176 of the trigger piece 166 engages the ridge 172 formed on the cylindrical section 170. Therefore it retains the toy missile 168 within the tubular housing 164. When the trigger piece 166 pivots, as a result of being pressed by a player, the narrow portion 176 of the trigger piece 166 disengages the ridge 172. Consequently the toy missile 168 is ejected by the coil spring 174. As is shown on FIGS. 1 and 2, the two missile launchers 162 provide the capability of launching toy missiles 168 either in a forward or a backward direction relative to the toy 20.

Although a detailed description of the assembly of mandibles 94, wing flapping assembly 128 and of the toy missile launchers 162 has been provided above, it is to be understood that these components of the toy 20 may be constructed differently from the structures described above. Accordingly, the exact mechanical details of the working parts of these components is not considered to be critical for the purpose of practicing the present invention. A particularly apparent modification of the wing flapping assembly would involve the provision of an electric motor to drive the wing flapping assembly.

FIG. 8 discloses the alternative configuration of the toy 20 of the preferred embodiment of the present invention, which has been briefly referred to above. In this alternative configuration the plug 32 of the head section 24 is friction fitted in the aperture 30 provided in the tail section 26. A second toy 178 is created by assembling the head 24 and tail section 26 in the hereinbefore described manner. This second toy 178, which also simulates an insect, includes one of the toy missile launchers 162, the assembly of mandibles 94, and the pivotable cover plate 82 features of the toy 20 described above.

Having disclosed the various component parts of the toy 20 of the preferred embodiment of the present invention the several play options offered by the toy 20 for a child player, are readily apparent. These play options include assembling and disassembling the toy 20, creating the second toy 178, folding and unfolding the leg assembly 72, placing a toy appendage in the cavity 78 of the head section 24, flapping the wings 130, activating the mandibles to grip an object and activating the toy missile launchers 162. Various modifications of the hereinbefore described toy may be readily apparent to those skilled in the toy manufacturing arts. Accordingly, the scope of the present invention should be interpreted solely from the following claims.

What is claimed is:

1. A toy vehicle configured to simulate an insect, the toy vehicle comprising:

an elongated body member having a head, a center and a tail section, the body member having two lateral sides;

at least one wing attached to the body member to be disposed on each lateral side, each wing being pivotable about a vertical axis;

two extension members configured to simulate mandibles of an insect, the extension members being attached to the head section, a plurality of legs mounted on each lateral side of the body member, each leg having a pivotable joint on an intermediate portion of each leg, whereby at least a portion of each leg may be folded to occupy space below the body member, first player actuated means included in the head section for moving the two extension members towards one another and means to grip an object.

2. The toy of claim 1 wherein the head section incorporates a cavity for accomodating toy objects.

3. The toy of claim 2 wherein a seat is included in the head section so that a toy figure placed in the cavity may be seated, and wherein a pivotable canopy is attached to the head section to cover the cavity.

4. The toy of claim 1 wherein a plurality of wheels are attached to the legs on each side of the body member.

5. The toy of claim 4 wherein the legs on each side of the body member are rigidly interconnected by a cross member whereby all legs on one side of the body member fold together.

6. The toy of claim 1 further comprising second means included in the body member for flapping the wings about a substantially horizontal axis.

7. The toy of claim 6 wherein four wings are attached to the body member, two wings being disposed on each lateral side.

8. A toy vehicle configured to simulate an insect, the toy vehicle comprising:

an elongated body member having a head, a center and a tail section, the body member having two lateral sides;

at least one wing attached to the body member on each lateral side, each wing being pivotable about both a vertical axis and a horizontal axis to permit the respective wings to simulate a flapping movement and to further be relatively positioned adjacent the body member; first means to provide operator actuation of a flapping movement;

means for locomotion of the vehicle across a support surface;

two rigid extension members movable towards and away from each other and configured to simulate mandibles of an insect, the extension members being movably attached to the head section, and second player actuated means included in the head section for urging both of the two extension members towards one another to permit gripping of an object.

* * * * *